United States Patent [19]

Frame

[11] 4,431,882

[45] Feb. 14, 1984

[54] TRANSPARENT CAPACITANCE MEMBRANE SWITCH

[75] Inventor: Norman J. Frame, Whitefish Bay, Wis.

[73] Assignee: W. H. Brady Co., Milwaukee, Wis.

[21] Appl. No.: 407,450

[22] Filed: Aug. 12, 1982

[51] Int. Cl.[3] ..... H01H 13/70; G08C 9/00

[52] U.S. Cl. ..... 200/5 A; 200/159 B; 200/DIG. 1; 340/365 C

[58] Field of Search ..... 200/5 R, 5 A, 159 B, 200/DIG. 1; 361/416, 322; 340/365 B, 365 S, 365 A, 365 C; 178/17 C

[56] References Cited

U.S. PATENT DOCUMENTS

| | | | |
|---|---|---|---|
| T904,008 | 11/1972 | Crouse | 178/17 C |
| 3,308,253 | 3/1967 | Krakinowski | 200/5 A |
| 3,560,256 | 2/1971 | Abrams | 361/416 |
| 3,676,616 | 7/1972 | Wiedmer | 200/5 R |
| 3,750,113 | 7/1973 | Cencel | 340/365 C |
| 3,778,816 | 12/1973 | Cuccio | 340/365 S |
| 4,015,254 | 3/1977 | Strandt | 340/365 R |
| 4,034,176 | 7/1977 | Larson | 200/5 A X |
| 4,038,167 | 7/1977 | Young | 361/322 X |
| 4,158,115 | 6/1979 | Parkinson | 200/5 A |
| 4,373,122 | 2/1983 | Frame | 200/159 B |
| 4,373,124 | 2/1983 | Frame | 200/5 A X |

*Primary Examiner*—J. R. Scott

[57] ABSTRACT

A more transparent capacitance membrane switch in which capacitance elements are offset from their associated switch locations so as to be out of the transparent field of view through the switch.

7 Claims, 3 Drawing Figures

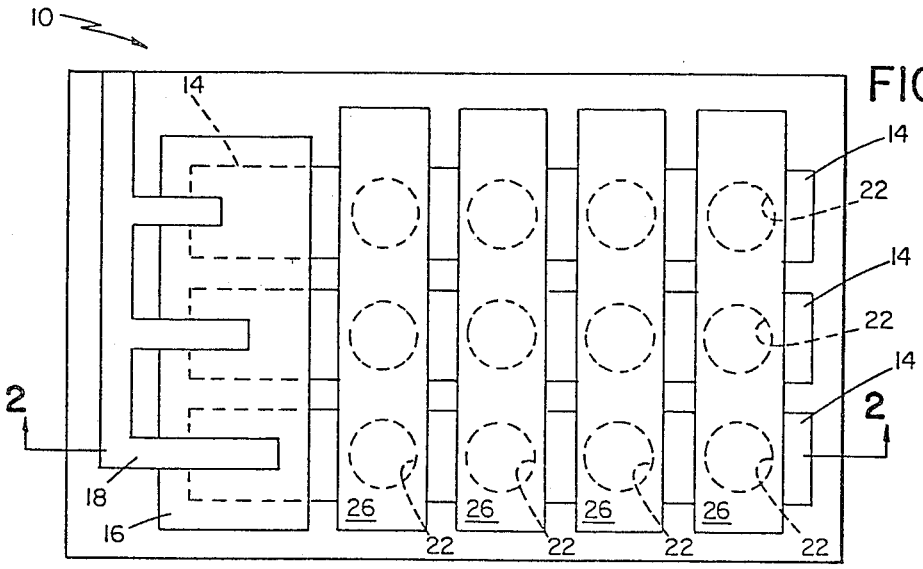
FIG 1
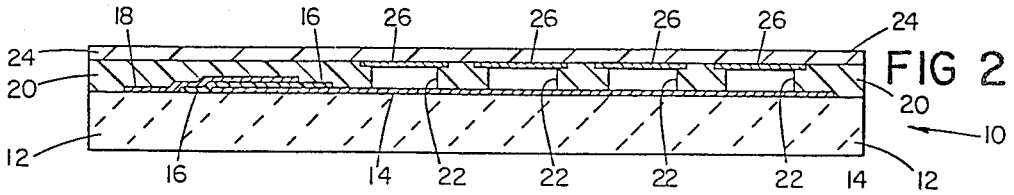
FIG 2
FIG 3
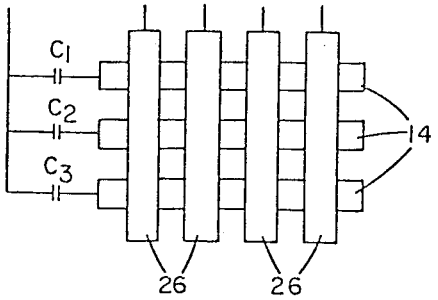

TRANSPARENT CAPACITANCE MEMBRANE SWITCH

BACKGROUND OF THE INVENTION

The invention relates to capacitance membrane switches of the type in which switch activation (e.g., depression of a flexible layer) causes a capacitance change detectable by external circuitry.

RELATED APPLICATIONS

This application is related to copending application Ser. No. 323,281, filed Nov. 20, 1981, and application Ser. No. 323,290, filed Nov. 20, 1981.

SUMMARY OF THE INVENTION

In general the invention features a transparent capacitance membrane switch in which capacitance elements are offset from their associated switch locations so as to be out of the transparent field of view through the switch. Placing the capacitive elements to one side reduces the number of layers of material at the switch location and thus improves transparency.

In preferred embodiments, the capacitance elements are formed by vacuum depositing conductive and dielectric films; the contact portions of the membrane switch are also vacuum-deposited films; the contact portions are arranged in rows and columns with each row connected to one capacitance element; and the membrane switch is applied to the face of a visual display by vacuum depositing the capacitance films and lowermost contact portions directly to the face of the display.

In such preferred, vacuum-deposited-film embodiments, the invention reduces the area of dielectric film deposited (e.g., only along the side of the switch rather than across its entire area) and thus eases the manufacturing task of depositing a uniformly thick layer. Also, the high dielectric coefficient of vacuum-depositable dielectric materials such as $Ta_2O_5$ makes possible high capacitance values despite the restriction placed on the capacitance area as the result of offsetting the capacitance from the switch locations. In an embodiment applied to the face of a visual display, the invention provides the advantages given in my copending U.S. patent application Ser. No. 399,716 entitled "Membrane Switch for Face of Visual Display" with the added advantage of improved transparency.

Other features and advantages of the invention will be apparent from the following description of the preferred embodiment, and from the claims.

PREFERRED EMBODIMENT

A preferred embodiment of the invention will now be described, after first briefly describing the drawings.

DRAWINGS

FIG. 1 is a plan view of said preferred embodiment.

FIG. 2 is an enlarged cross-sectional view taken at 2—2 of FIG. 1, with the thicknesses of various layers greatly exaggerated and not to scale.

FIG. 3 is a schematic diagram of the electrical elements of said embodiment.

DESCRIPTION

Turning now to the drawings, there is shown a membrane switch 10 (i.e., a switch in which a flexible layer is flexed in order to produce a signal output). Glass substrate 12 (FIG. 2) has vacuum deposited on its upper surface (by sputtering through a suitable mask) three horizontal row conductors 14 (indium tin oxide (ITO) film, 10% indium, 2000 Angstroms thick). At the left edge of the glass substrate there are formed three thin-film capacitors $C_1$–$C_3$ of different capacitance values. Pad 16 dielectric material ($Ta_2O_5$, 2000 Angstroms) is vacuum deposited over the left ends of row conductors 14. The pad is, in turn, covered by a vacuum deposited layer 18 of aluminum, which extends (FIG. 1) from the pad along the left edge of the switch to the upper edge where a connection can be made to external circuitry. The areas of aluminum overlapping the $Ta_2O_5$ dielectric material and row conductors are each a different size to provide the three different capacitance values $C_1$–$C_3$ (8000, 12000, and 16000 picofarads).

On top of glass substrate 12 is a top layer 24 of 5-mil thick transparent polyester film on which has been vacuum deposited (by sputtering through a suitable mask) four column conductors 26 (ITO, 2000 Angstroms).

Between top layer 24 and glass substrate 12 there is spacer layer 20 (2 mil transparent polyester with 1 mil transparent adhesive on each side), which has generally circular openings 22 aligned with the twelve switch locations defined by the areas where row conductors 14 cross column conductors 26.

Electrical connections are made in a conventional manner to conductive layer 18 and to column conductors 26.

In operation, a selected switch is activated by depression of top layer 24 at the desired switch location. That action causes a column conductor 26 on the undersurface of layer 24 to engage a row conductor 14 through an opening 22 in the spacer layer. External detection circuitry then senses the value of the capacitance produced and generates a signal identifying the switch location. Detection circuitry such as that described in my copending U.S. patent application Ser. No. 379,770 (incorporated herein by reference) can be used to detect which switch has been activated.

Other embodiments of the invention are within the following claims.

What is claimed is:

1. A capacitance membrane switch, comprising a substrate supporting a first contact portion, a flexible membrane supporting a second contact portion aligned over said first contact portion, means for spacing said membrane from said substrate in the absence of an actuating force on said flexible membrane, said first and second contact portions, substrate, flexible layer, and means for spacing being together at least partially transparent to light travelling therethrough, thereby defining a zone of transparency surrounding and including said contact portions, and a capacitance element electrically connected to one of said first and second contact portions, said capacitance element being offset from said contact portions so as to be located outside said zone of transparency.

2. The switch of claim 1 wherein said capacitance element comprises a first vacuum-deposited conductive film, a dielectric film vacuum-deposited over at least a portion of said first conductive film, and a second conductive film vacuum-deposited over at least a portion of said dielectric film and first conductive film so as to form a capacitive region in which all three films overlap, and wherein said first contact portion is integral with or electrically connected to one of said first and second conductive films.

3. The switch of claim 2 wherein said first and second contact portions are vacuum-deposited thin films.

4. The switch of claim 2 wherein there are a plurality of said first and second portions forming a plurality of switch locations, said zone of transparency surrounding all of said plurality, and there are a plurality of said capacitance elements each electrically connected with one or more of said first or second contact portions, all of said capacitance elements being located outside said zone of transparency.

5. The switch of claim 4 wherein said first contact portions are elongated, vacuum-deposited, conductive films arranged in spaced-apart rows, said second contact portions are elongated, vacuum-deposited, conductive films arranged in spaced-apart columns transverse to said rows, and said capacitance elements reside on said substrate and each is connected with one of said first contact portions.

6. The switch of claim 5 wherein each said first contact portion and one of said conductive films of each said capacitance element are integral extensions of the same vacuum-deposited, conductive film.

7. The switch of claim 2 wherein said substrate is the face of a visual display.

* * * * *